United States Patent [19]

Kabele

[11] 4,109,751

[45] Aug. 29, 1978

[54] NOISE SILENCER

[75] Inventor: Dennis Frederick Kabele, Cedar Falls, Iowa

[73] Assignee: Deere & Company, Moline, Ill.

[21] Appl. No.: 718,091

[22] Filed: Aug. 26, 1976

[51] Int. Cl.[2] ..... F01N 1/00; F02M 35/00; G10K 11/00

[52] U.S. Cl. ..... 181/247; 181/229; 181/255; 181/272; 181/296

[58] Field of Search ..... 181/206, 249, 255, 296, 181/266, 272, 273, 276

[56] References Cited

U.S. PATENT DOCUMENTS 1,910,672 5/1933 Bourne ..... 181/273

*Primary Examiner*—L. T. Hix
*Assistant Examiner*—Benjamin R. Fuller
*Attorney, Agent, or Firm*—Fraser and Bogucki

[57] ABSTRACT

A noise silencer for an internal combustion engine has a hollow pipe serving as an air intake for the internal combustion engine and having a length L which is an even submultiple of the wavelength at the lowest of a range of noise frequencies from the internal combustion engine which are to be attenuated. The hollow pipe attenuates noise at the lowest frequency and at certain other frequencies throughout the range. Intervening frequencies are attenuated by at least one expansion chamber coupled to the pipe and having extended inlets and outlets the lengths of which are even submultiples of L. In certain preferred arrangements of the silencer the hollow pipe extends into one expansion chamber forming an extended outlet, a second hollow pipe extends between and within the expansion chamber and a second expansion chamber forming an extended inlet and an extended outlet and a third hollow pipe extends into the second expansion chamber from the internal combustion engine to form an extended inlet. The extended inlets and outlets have lengths equal to L/2, L/4, L/8 and L/16.

9 Claims, 13 Drawing Figures

NOISE SILENCER

BACKGROUND OF THE INVENTION

1. Field of the Invention

The present invention relates to noise silencers, and more particularly to reactive silencers comprising one or more expansion chambers with extended inlets and outlets for use with internal combustion engines.

2. History of the Prior Art

It is known to attenuate noise from sources such as internal combustion engines using reactive silencers comprised of one or more expansion chambers with extended inlets and outlets. Such silencers operate on the principle that an impedance mismatch causes sound energy to be reflected back toward the source instead of being radiated. Examples of silencers of this type are shown in U.S. Pat. Nos. 3,741,336, 2,765,044 and 3,807,527, and in an article by E. J. Wonnacott at pp. 17–26 of the *Journal of Sound and Vibration* (1974) 37(1) entitled LOWER EXHAUST NOISE FROM BETTER SILENCER DESIGN TECHNIQUES.

The problem with many prior art silencers of this type lies in design difficulties. Designing a silencer for a particular application is usually a haphazard process at best, and often results in configurations of considerable complexity and expense. Due to a lack of understanding of the apparatus involved, many silencers have been assembled on a trial and error basis with various components being added or substituted until the attenuation appears to be acceptable. At that, it is often found that the attenuation will vary significantly over even a limited range of frequencies so as to detract from the versatility of the silencer. For example, the Wonnacott article which shows a pair of expansion chambers and connected tailpipe fails to recognize that the tailpipe acts to attenuate sound at specific wavelengths similar to extended inlet and outlet tubes. This affects the design configuration of the silencer and recognition of this permits a better design for attenuation over a wide frequency range.

Accordingly, it would be desirable to provide a noise silencer which is of relatively simple and economical design and yet which provides substantial attenuation of unwanted noise over a relatively broad frequency range.

It would furthermore be desirable to provide a noise silencer which is easily designed for a specified application using a systematic approach.

BRIEF DESCRIPTION OF THE INVENTION

Noise silencers in accordance with the invention include a hollow pipe having a length which is directly related to the wavelength of noise at the lowest frequency of a range of frequencies to be attenuated. The length L of the hollow pipe is preferably chosen as an even submultiple of the wavelength such as one-fourth the wavelength. The hollow pipe is coupled to an arrangement of expansion chambers with extended inlets and outlets having lengths which are different even submultiples of the length L.

The hollow pipe provides substantial attenuation at the lowest frequency in the range of interest as well as at certain other frequencies within the range. However, intervening frequencies are not attenuated and may actually be amplified to some extent by the hollow pipe. The intervening frequencies are attenuated by use of extended inlets and outlets which are dimensioned to be even submultiples of the length L of the hollow pipe. This provides a substantial attenuation profile across a relatively broad frequency range of interest. Preferably the extended inlets and outlets are provided with dimensions L/2, L/4, L/8, L/16 etc.

In preferred embodiments of noise silencers according to the invention the hollow pipe of length L is mounted so as to extend into and form an extended outlet within one of a pair of hollow expansion chambers. A second hollow pipe extends between and into the pair of expansion chambers to form an extended inlet and an extended outlet. A third hollow pipe extends into the second expansion chamber forming an extended inlet. The opposite end of the third hollow pipe is coupled to the noise source such as the air intake of an internal combustion engine. The extended inlets and outlets are L/2, L/4, L/8 and L/16 in length.

In one particular noise silencer designed for use with a relatively small internal combustion engine, a housing has a partition disposed across the hollow interior thereof so as to divide the interior into a pair of expansion chambers. A hollow pipe of length L extends into the housing within one of the expansion chambers to form an extended outlet. A second hollow pipe disposed within the housing extends through the partition and into the first and second expansion chambers, forming an extended inlet and an extended outlet. A third hollow pipe has one end coupled to the air intake of the internal combustion engine. The opposite end of the third hollow pipe extends into the second of the pair of expansion chambers to form an extended inlet. With the length L chosen to equal an even submultiple of the wavelength of engine noise at a frequency such as 200 Hz, at the lower end of a typical range of interest such as 200–2000 Hz, it has been found that the attenuation is relatively substantial over the entire range.

BRIEF DESCRIPTION OF THE DRAWINGS

A better understanding of the invention may be had by reference to the following description, taken in conjunction with the accompanying drawings, in which.

DETAILED DESCRIPTION

Figure 1:
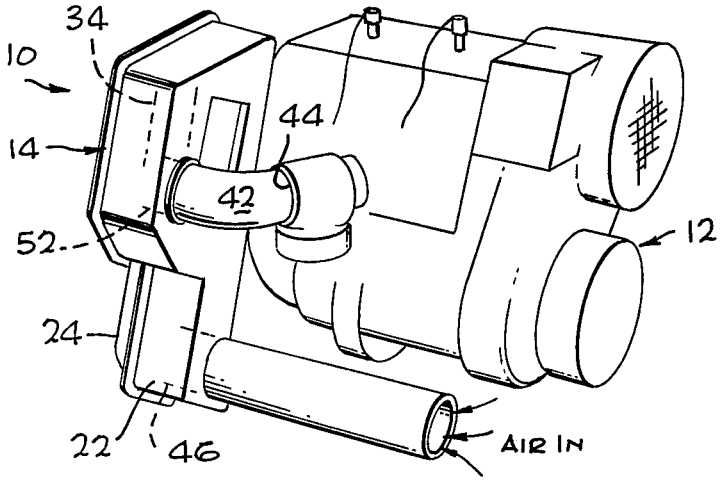
FIG. 1 is a perspective view of a noise silencer in accordance with the invention installed on an internal combustion engine.
Figure 2:
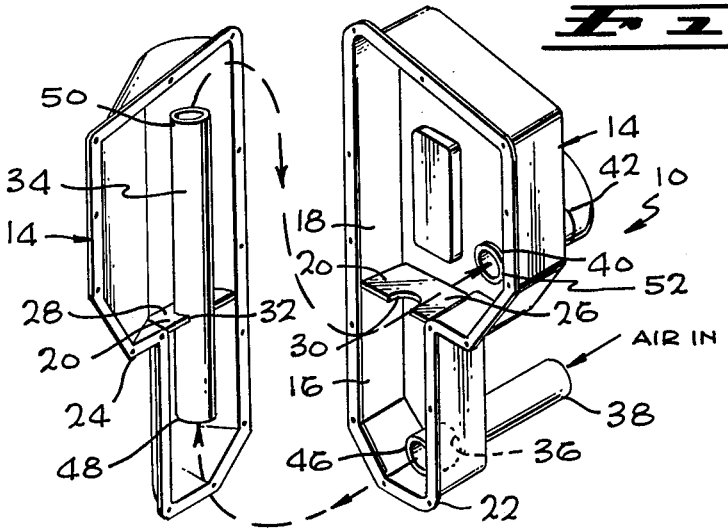
FIG. 2 is a broken-apart plan view of the noise silencer of FIG. 1 showing the interior details.

FIG. 1 shows a noise silencer 10 in accordance with the invention installed on an internal combustion engine 12. The internal details of the silencer 10 are shown in FIG. 2. The silencer 10 includes a housing 14 having a hollow interior which is divided into a pair of expansion chambers 16 and 18 by a partition 20. As shown in FIG. 2 the housing 14 is comprised of a pair of opposite mating shells 22 and 24. The partition 20 is likewise comprised of opposite portions 26 and 28 mounted within the shells 22 and 24 respectively. The portions 26 and 28 have semi-circular recesses 30 and 32 respectively therein for surrounding and accommodating a hollow center pipe 34 when the opposite shells 22 and 24 of the housing are joined together. The center pipe 34 which is thus mounted by the opposite portions 26 and 28 of the partition 20 extends into both expansion chambers 16 and 18. The expansion chamber 16 has a circular opening 36 therein for receiving a hollow tailpipe 38, the opening 36 being within the shell 22. Likewise the expansion chamber 18 has a circular opening 40 therein for receiving a hollow coupling pipe 42, the opening 40 being within the shell 22.

The noise silencer 10 may be coupled either to the air intake or the exhaust outlet of the internal combustion engine 12. In the present example the coupling pipe 42 is coupled to the air intake 44 of the engine 12 which is the preferred approach since the sound waves at the air intake are of lower magnitude than at the exhaust and therefore more compatible with linear acoustic theory. When designing a silencer in accordance with the invention for use with the engine exhaust it must be remembered that the hotter temperatures affect the velocity of sound and that linear acoustic theory doesn't apply as well because of the high magnitude of the sound waves which can develop into shock waves within a shorter distance. This being the case air flows through the silencer 10 as indicated by the arrows in FIGS. 1 and 2. More specifically air enters the tailpipe 38 from which it flows into the first expansion chamber 16. From the chamber 16 the air enters and flows through the center pipe 34 to the expansion chamber 18. From the chamber 18 the air enters and flows through the coupling pipe 42 and into the air intake 44 of the engine 12.

The silencer 10 is a reactive type silencer which basically causes the sound energy from the engine 12 to be reflected back toward the engine. Reactive silencers have proven to be effective with constant velocity noise sources which internal combustion engines closely approximate. Sound energy entering the coupling pipe 42 from the air intake 44 is attenuated prior to exiting from the tailpipe 38. This attenuation can be expressed in terms of transmission loss which is the ratio of entering to leaving acoustic energy and by insertion loss which is the reduction of radiated acoustic energy from the engine with the silencer 10 installed. In the event the silencer 10 is coupled to the exhaust outlet of the engine 12, the flow of exhaust through the silencer 10 is the reverse of that shown by the arrows in FIGS. 1 and 2. However, the noise attenuation function of the silencer 10 is still the same, namely sound energy entering the coupling pipe 42 from the exhaust outlet of the engine 12 is partially reflected back toward the engine 12 prior to exiting the tailpipe 38. Only a relatively small amount of the sound energy reflected by the silencer toward the engine is reflected by the engine back toward the silencer, and the present discussion assumes negligible reflections of sound energy by the engine.

As seen in FIG. 2 the tailpipe 38 extends into the expansion chamber 16 a selected distance to form an extended outlet 46. A portion of the center pipe 34 extends into the expansion chamber 16 a selected distance to form an extended inlet 48 with the remainder of the center pipe 34 extending into the expansion chamber 18 a selected distance to form an extended outlet 50. The coupling 42 extends through the opening 40 and into the expansion chamber 18 a selected distance to form an extended inlet 52.

In accordance with the invention the length of the tailpipe 38 is chosen in accordance with the wavelength of noise at the lowest frequency of a range of frequencies to be attenuated. Typically the length L of the tailpipe 38 is chosen to be an even submultiple such as one-fourth of the wavelength of the lowest frequency. This results in attenuation of noise at the lowest frequency and at certain other frequencies throughout the frequency range. However, the intervening frequencies are not attenuated and in some cases are actually amplified by the tailpipe 38. Such frequencies are substantially attenuated before they reach the tailpipe 38 by proper choice of the lengths of the extended inlets and outlets 46, 48, 50 and 52. Specifically, it has been found that the intervening frequencies are substantially attenuated by making the length of each of the inlets and outlets 46, 48, 50 and 52 equal to a different even submultiple of the length L of the tailpipe 38. Typical lenghts chosen for the extended inlets and outlets are L/2, L/4, L/8 and L/16. While four extended inlets and outlets are shown in the present example, other numbers can be used as appropriate or necessary. For example, if more than four extended inlets and outlets are present, the fifth extended inlet or outlet may be dimensioned L/32, the sixth extended inlet or outlet may be dimensioned L/64, and so on. In still other arrangements a number less than four such as two or three extended inlets and outlets may suffice. The arrangement of the various extended inlets and outlets throughout the silencer in terms of size is not particularly important and depends primarily upon design and manufacturing considerations.

Much of the discussion hereafter relates to the manner in which the noise silencer 10 was designed for use with the internal combustion engine of a snowmobile. For such applications the frequency range of interest is 200–2000 Hz. The wavelength at that frequency is equal to $c/f$ where $c$ is the sonic velocity of intake gas and $f$ is the frequency. If $c$ is 1,130 ft./second and $f$ is 200 Hz, then the wavelength is 5.64 ft. One-fourth of this is 1.41 ft. or approximately 17 in. Since the first peak of the transmission loss curve of a tailpipe 17 in. in length is fairly broad, the tailpipe length L can be somewhat shorter and still obtain satisfactory silencing at 200 Hz. Accordingly the tailpipe length is chosen to be 16 in. so as to provide substantial attenuation of noise from the internal combustion engine at 200 Hz.

Figure 3:
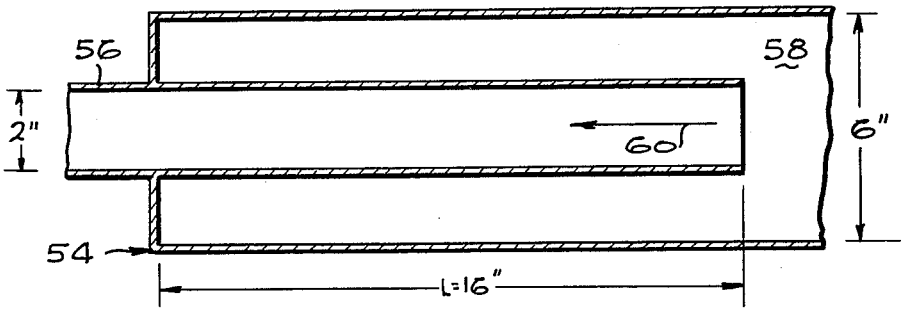
FIG. 3 is a sectional view of an extended outlet useful in understanding the operation of the noise silencer of FIG. 1.

FIG. 3 shows an extended outlet 54 in which a length of 16 in. is used. The extended outlet 54 is formed by a hollow pipe 56, 2 in. in diameter, and an expansion chamber 58 which is 6 in. in diameter. Sound wave energy is assumed to propagate in the direction of an arrow 60. The acoustic performance of the extended outlet 54 of FIG. 3 for the various wavelengths of the frequency range 200–2000 Hz and using one dimensional linear acoustic theory is shown by the solid curve 66 in FIG. 6. The curve 66 assumes that the hollow pipe 56 extends an infinite distance on the outside of the expansion chamber 58 so that there is no reflection back to the right as seen in FIG. 3. It will be noted that the performance of the extended outlet 54 is very frequency dependent. The extended outlet acts as a quarter-wavelength resonator at that wavelength divided by odd integers. If L which is the length of the extended inlet is deemed to be one-fourth of the wavelength at the lowest frequency in the frequency range 200–2000 Hz of interest, then transmission loss peaks occur at 4L, 4L/3, 4L/5 and so on. The magnitude of the transmission loss is proportional to the ratio of areas of the pipe 56 and the expansion chamber 58, while the extended length L of pipe 56 controls the frequency characteristics of the extended outlet.

Figure 4:
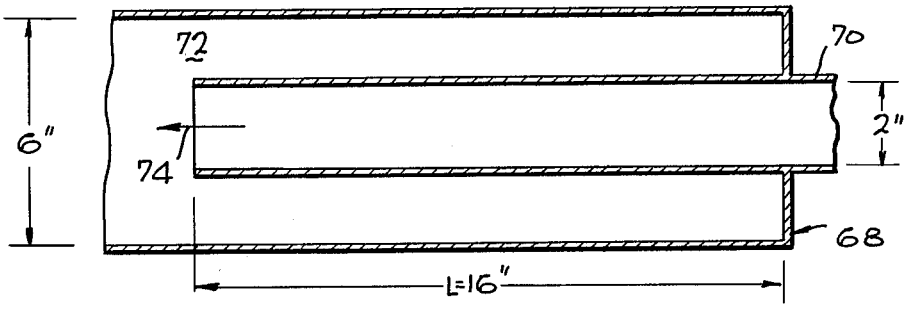
FIG. 4 is a sectional view of an extended inlet useful in understanding the operation of the noise silencer of FIG. 1.

FIG. 4 depicts an extended inlet 68 having a length L which is 16 in. The extended inlet 68 is comprised of a hollow pipe 70 which is 2 in. in diameter and an expansion chamber 72 which is 6 in. in diameter. The sound wave energy propagates in the direction of an arrow 74. Again, reflection of sound back from the engine is assumed to be negligible. The transmission loss of the extended inlet 68 over the frequency range 200–2000 Hz is shown by the dashed line 76 in FIG. 6. It will be noted from FIG. 6 that the attenuation peaks of the extended inlet of FIG. 4 occur at the same wavelengths as in the case of the extended outlet of FIG. 3. However, the attenuation is greater. The result is that the characteristic 76 for the extended inlet of FIG. 4 is like the characteristic 66 of the extended outlet FIG. 3 except that it is raised on the attenuation scale of FIG. 6. In the case of the extended outlet of FIG. 3 the transmission loss between the peaks 4L, 4L/3, 4L/5, 4L/7 and 4L/9 becomes negative at peaks occuring at 4L/2, 4L/4, 4L/6, 4L/8 and 4L/10. The area reduction across the junction of the pipe 56 and the expansion chamber 58 of the extended outlet 54 actually intensifies the pressure wave.

Figure 6:
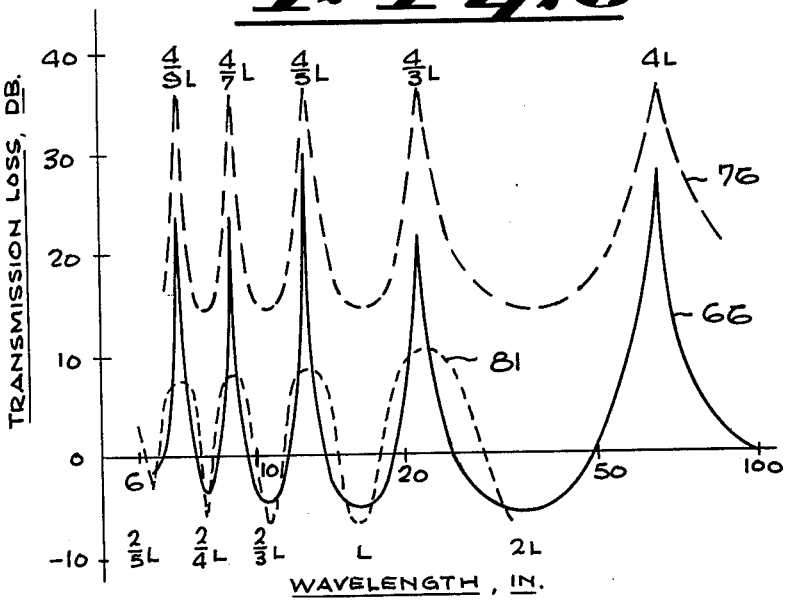
FIG. 6 is a diagrammatic plot of transmission loss as a function of noise wavelength for the extended outlet of FIG. 3, the extended inlet of FIG. 4, and the intake pipe of FIG. 5.
Figure 5:
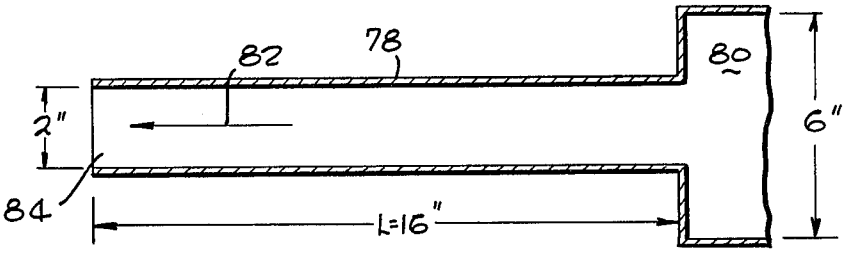
FIG. 5 is a sectional view of an intake pipe useful in understanding the operation of the silencer of FIG. 1.

The hollow pipe through which the sound is radiated is termed the tailpipe. It comprises an air intake pipe for the internal combustion engine in the present example, but may instead comprise the exhaust outlet where the silencer is designed for use with the engine exhaust rather than the air intake as noted above. A tailpipe 78 having a length L of 16 in. and a diameter of 2 in. is shown in FIG. 5 as emanating from an expansion chamber 80 which is 6 in. in diameter. The sound wave energy propagates in the direction of an arrow 82. The transmission loss of the tailpipe 78 over the frequency range 200–2000 Hz is shown by the dotted line 81 in FIG. 6. Because of reflection from an open end 84 of the tailpipe 78 back toward the noise source, the tailpipe 78 attenuates some frequencies while amplifying others. For attenuation, it performs like an extended inlet or outlet, producing transmission loss peaks at wavelengths of 4L, 4L/3, 4L/5, 4L/7 and 4L/9 as shown in FIG. 6. On the other hand the tailpipe 78 amplifies sound at wavelengths of 2L, 2L/2, 2L/3, 2L/4 and 2L/5. Consequently the characteristic 81 of the tailpipe 78 is similar to the characteristics 66 and 76 shown in FIG. 6 for the extended outlet of FIG. 3 and the extended inlet of FIG. 4.

To get broadband silencing, the tailpipe amplification frequencies or "holes" must be compensated for by extended inlets and outlets. This is seen by the following:

| Tailpipe holes = Extension transmission loss | |
|---|---|
| $2L_t/n = 4L_e/m$ | $n = 1, 2, 3,$ |
| For $Le = Lt/2$, | $m = 1, 3, 5, 7,$ |
| $n = m$ | $L_t$ = tailpipe length |
| | $L_e$ = extension length |

Thus with an extension length of half the tailpipe length, compensation will occur at the first, third, fifth, etc., tailpipe holes. For an extension length of one-fourth the tailpipe length, compensation will occur at the second, sixth, 10th, 14th, etc., tailpipe holes. For an extension length of one-eighth the tailpipe length, compensation will occur at the fourth, twelfth, twentieth, etc., tailpipe holes. This procedure of halving the extension lengths continues for as many chambers as there are in the silencer.

Figure 7:
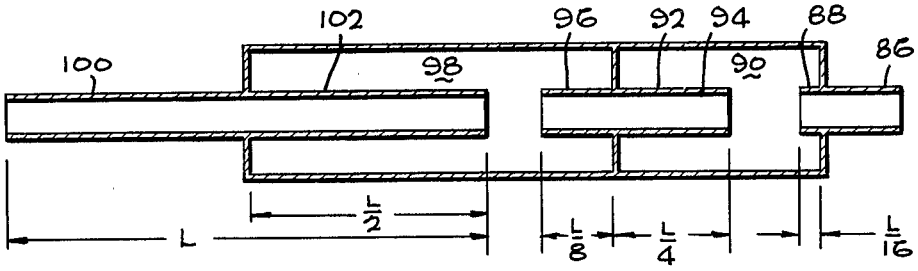
FIG. 7 is a sectional view of one preferred form of noise silencer in accordance with the invention.
Figure 8:
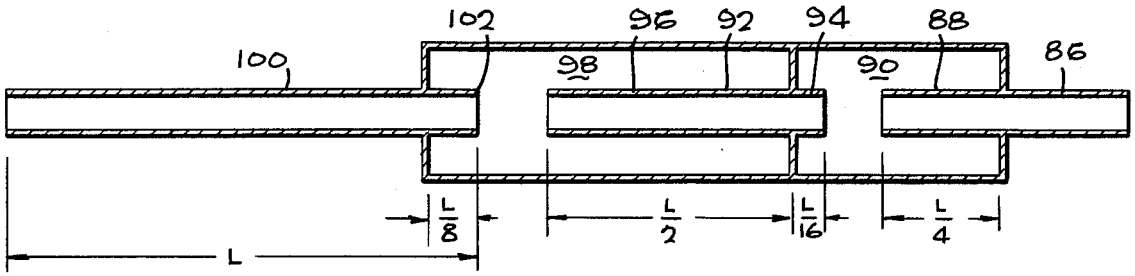
FIG. 8 is a sectional view of another preferred form of noise silencer in accordance with the invention.

Two different arrangements of noise silencers according to the invention are shown in FIGS. 7 and 8. In both cases a coupling pipe 86 forms an extended inlet 88 within a first expansion chamber 90, a center pipe 92 forms an extended outlet 94 within the expansion chamber 90 and an extended inlet 96 within a second expansion chamber 98, and a tailpipe 100 of length L forms an extended outlet 102 within the second expansion chamber 98. In both cases the extended inlets and outlets have the different even submultiple lengths L/2, L/4, L/8 and L/16. However, the arrangement of the different lengths throughout the silencer differs in each case.

Figure 9:
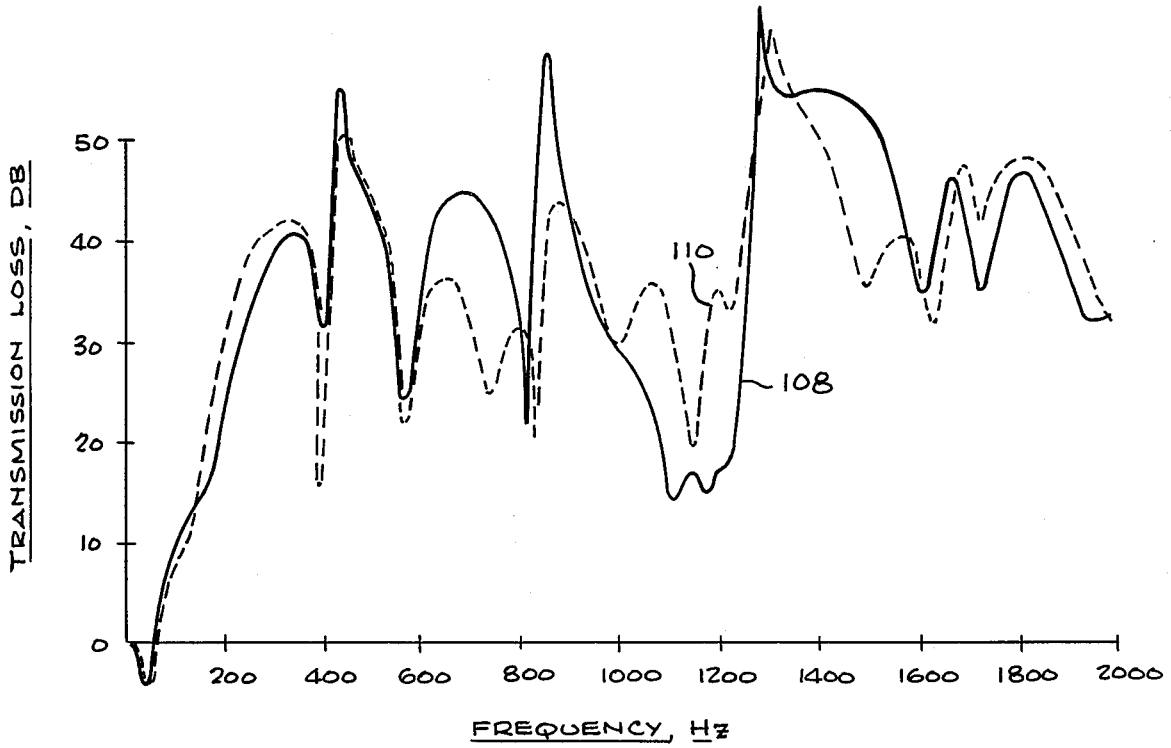
FIG. 9 is a diagrammatic plot of transmission loss as a function of noise frequency for the noise silencers of FIGS. 7 and 8.

The transmission loss of the noise silencer of FIG. 7 (L=16 inches) as a function of frequency is shown by a solid line curve 108 in FIG. 9. The transmission loss of the arrangement of FIG. 8 as a function of frequency is shown by the dashed line curve 110 in FIG. 9. In the case of a snowmobile a desirable goal in reducing noise from the internal combustion engine is to provide a 20 decibel transmission loss over the frequency band 200–2000 Hz. That being the case the embodiment of FIG. 8 would be preferable over the embodiment of FIG. 7. The transmission loss of the embodiment of FIG. 8 as represented by the curve 110 briefly decreases to less than 20 db at about 400 Hz but otherwise is greater than 20 db throughout the frequency range 200–2000 Hz. On the other hand the curve 108 corresponding to the silencer of FIG. 7 decreases to less than 20 db at frequencies around 200 Hz and particularly within a range of approximately 1100–1250 Hz.

Figure 10:
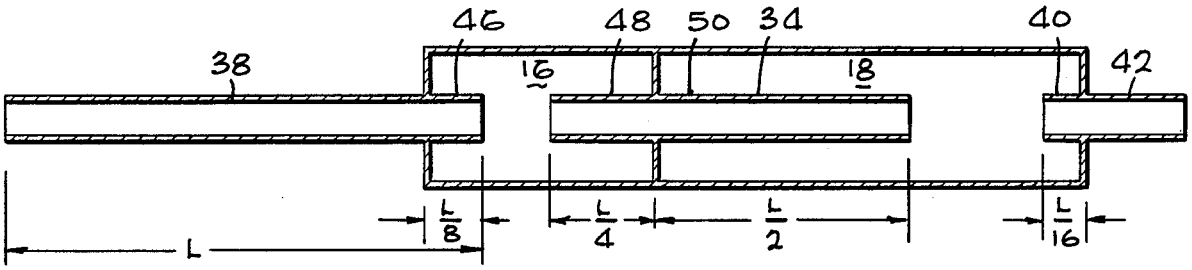
FIG. 10 is a sectional view of a tube-in-line model of the noise silencer of FIG. 1.

FIG. 10 shows a noise silencer similar to the silencers of FIGS. 7 and 8 but with the lengths of the extended inlets and outlets arranged differently. The particular arrangement of FIG. 10 corresponds to the silencer 10 of FIGS. 1 and 2 except that it assumes a tube-in-line configuration. The extended inlet 40 has a length L/16, the extended outlet 50 has a length L/2, the extended inlet 48 has a length L/4 and the extended outlet 46 has a length L/8.

Figure 11:
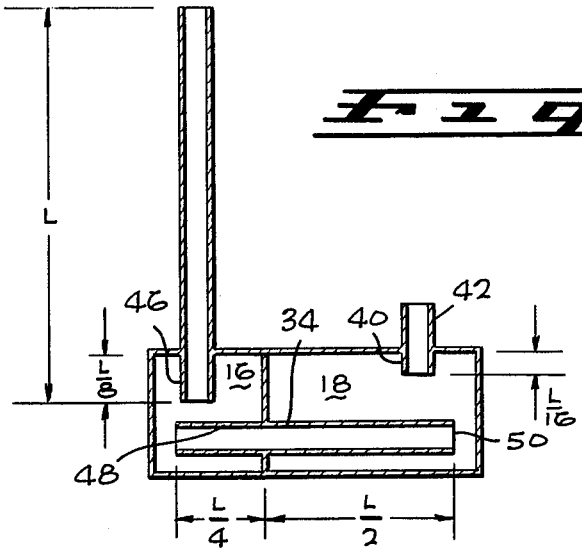
FIG. 11 is a sectional view of a non-tube-in-line model of the noise silencer of FIG. 1.

The arrangement of FIG. 11 is the same as that of FIG. 10 except that it represents the actual non-tube-in-line or non-axial configuration of the silencer 10 of FIGS. 1 and 2. The non-axial configuration is the consequence of compact packaging of the silencer 10 so that it can fit into the limited space available in a snowmobile. As seen in FIG. 11 the tailpipe 38, the center pipe 34 and the connecting pipe 42 are not coaxial with one another as in the case of the tube-in-line arrangement of FIG. 10.

Figure 12:
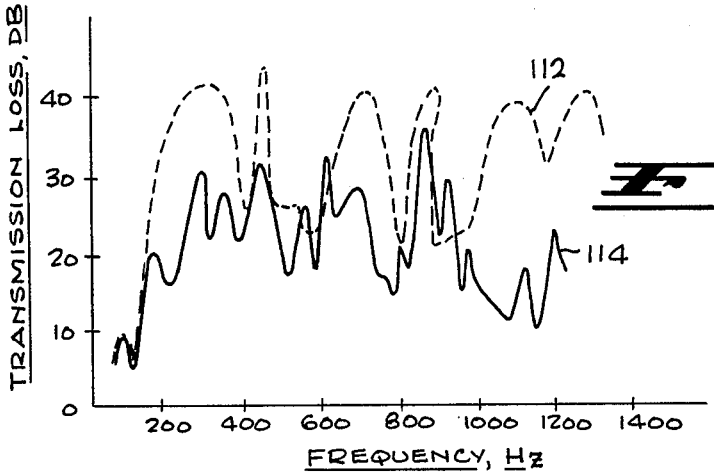
FIG. 12 is a diagrammatic plot of transmission loss as a function of noise frequency for the noise silencers of FIGS. 7 and 11.

FIG. 12 depicts the transmission loss as a function of frequency for the silencers of FIGS. 10 and 11. The predicted transmission loss of the silencer of FIG. 10 is represented by the dashed line curve 112 and the measured transmission loss of the silencer of FIG. 11 is represented by the solid line curve 114. It will be noted that there is reasonable similarity between the two embodiments up to about 1000 Hz. Above that frequency there are considerable differences which are probably due to the non-tube-in-line orientation of the pipes in FIG. 11 and the three dimensional wave propagation effect which occurs at the higher frequencies.

Figure 13:
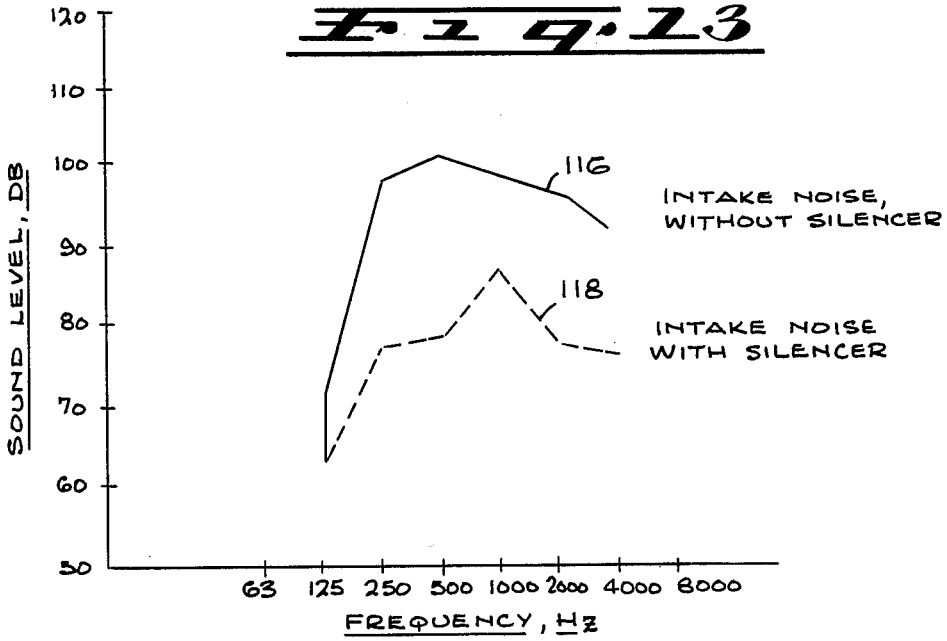
FIG. 13 is a diagrammatic plot of octaveband noise levels as a function of frequency produced by the internal combustion engine of FIG. 1 with the noise silencer and without the noise silencer.

FIG. 13 is a graphical representation of the air intake sound level of the internal combustion engine 12, both with and without the noise silencer 10. The sound level without the silencer 10 is shown by a solid line curve 116, and the sound level with the silencer 10 is shown by the dashed line curve 118. The sound level represents the "A" weighted sound level at a distance of 75 in. It will be noted that the silencer 10 provides a substantial amount of attenuation relative to the unsilenced engine over the frequency range 200–2000 Hz of interest.

While the invention has been particularily shown and described with reference to a preferred embodiment thereof, it will be understood by those skilled in the art that various changes in form and details may be made therein without departing from the spirit and scope of the invention.

What is claimed is:

1. A silencer for use with an engine having an air intake and an exhaust comprising the combination of a first hollow pipe coupled to the air intake or the exhaust of the engine, a second hollow pipe having a length which is an even submultiple of the wavelength of noise at the lowest frequency of a range of frequencies to be attenuated, and a plurality of expansion chamber inlets and outlets coupled between the first hollow pipe and the second hollow pipe, each of the plurality of expansion chamber inlets and outlets having a length which is an even submultiple of the length of the second hollow pipe and which is different from the lengths of the other inlets and outlets.

2. A silencer for attenuating noise within a selected frequency range comprising a hollow pipe having a length L comprising a portion of the wavelength of noise at a frequency at the lower end of the selected frequency range, and a plurality of extended expansion chamber inlets and outlets forming an arrangement which is coupled to an end of the hollow pipe, each of the inlets and outlets having a length which is a different even submultiple of L.

3. The invention defined in claim 2, wherein the lengths of the extended expansion chamber inlets and outlets are equal to L/2, L/4, L/8 and L/16.

4. The invention defined in claim 2, wherein the length L is an even submultiple of the wavelength of the frequency at the lower end of the selected frequency range.

5. A silencer comprising the combination of first and second hollow expansion chambers, a first hollow pipe disposed between and extending into the first and second expansion chambers by selected distances, a second hollow pipe extending into the first expansion chamber a selected distance and a third hollow pipe extending into the second expansion chamber a selected distance, the third hollow pipe having a selected length and the selected distances comprising different even submultiples of the selected length.

6. The invention defined in claim 5, wherein the first hollow pipe extends into the first expansion chamber by a distance equal to one-half the selected length of the third hollow pipe and into the second expansion chamber by a distance equal to one-fourth the selected length of the third hollow pipe, the second hollow pipe extends into the first expansion chamber by a distance equal to one-sixteenth the selected length of the third hollow pipe, and the third hollow pipe extends into the second expansion chamber by a distance equal to one-eighth the selected length of the third hollow pipe.

7. The invention defined in claim 5, wherein the first hollow pipe extends into the first expansion chamber by a distance equal to one-fourth the selected length of the third hollow pipe and into the second expansion chamber by a distance equal to one-eighth the selected length of the third hollow pipe, the second hollow pipe extends into the first expansion chamber by a distance equal to one-sixteenth the selected length of the third hollow pipe, and the third hollow pipe extends into the second expansion chamber by a distance equal to one-half the selected length of the third hollow pipe.

8. The invention defined in claim 5, wherein the first hollow pipe extends into the first expansion chamber by a distance equal to one-sixteenth the selected length of the third hollow pipe and into the second expansion chamber by a distance equal to one-half the selected length of the third hollow pipe, the second hollow pipe extends into the first expansion chamber by a distance equal to one-fourth the selected length of the third hollow pipe, and the third hollow pipe extends into the second expansion chamber by a distance equal to one-eighth the selected length of the third hollow pipe.

9. A silencer for attenuating a range of frequencies of noise from an internal combustion engine comprising a housing having first and second openings therein, a hollow interior and a partition dividing the hollow interior into a pair of chambers, a first hollow pipe extending through the partition and into each of the pair of chambers, a second hollow pipe having one end extending through the first opening in the housing and into a first one of the pair of chambers and an opposite end adapted to be coupled to the air intake or exhaust outlet of an internal combustion engine, and a third hollow pipe having one end extending through the second opening in the housing and into a second one of the pair of chambers and an opposite end adapted to form an air intake or an exhaust outlet for the internal combustion engine, the third hollow pipe having a length L which is one-fourth the wavelength of noise at the lowest frequency of the range of frequencies to be attenuated and extending into the second one of the pair of chambers by a distance L/8, the second hollow pipe extending into the second one of the pair of chambers by a distance L/4 and into the first one of the pair of chambers by a distance L/2, and the first hollow pipe extending into the first one of the pair of chambers by a distance L/16.

* * * * *